US008784145B2

(12) United States Patent
Koyama et al.

(10) Patent No.: US 8,784,145 B2
(45) Date of Patent: Jul. 22, 2014

(54) TERMINAL AND CONNECTOR USING THE SAME

(75) Inventors: Jiro Koyama, Otsu (JP); Hirotada Teranishi, Kusatsu (JP)

(73) Assignee: Omron Corporation, Kyoto (JP)

( * ) Notice: Subject to any disclaimer, the term of this patent is extended or adjusted under 35 U.S.C. 154(b) by 231 days.

(21) Appl. No.: 13/395,708

(22) PCT Filed: Mar. 24, 2011

(86) PCT No.: PCT/JP2011/057180
§ 371 (c)(1),
(2), (4) Date: Mar. 13, 2012

(87) PCT Pub. No.: WO2012/124170
PCT Pub. Date: Sep. 20, 2012

(65) Prior Publication Data

US 2012/0238141 A1 Sep. 20, 2012

(30) Foreign Application Priority Data

Mar. 14, 2011 (JP) ..... 2011-055727

(51) Int. Cl.
*H01R 4/48* (2006.01)

(52) U.S. Cl.
USPC ..... 439/862; 439/500; 439/700

(58) Field of Classification Search
USPC ..... 439/474, 500, 700, 862
See application file for complete search history.

(56) References Cited

U.S. PATENT DOCUMENTS

| | | | | |
|---|---|---|---|---|
| 4,995,816 | A * | 2/1991 | Grabbe | 439/71 |
| 5,427,535 | A * | 6/1995 | Sinclair | 439/66 |
| 5,772,449 | A * | 6/1998 | Feldmeier et al. | 439/66 |
| 6,200,167 | B1 * | 3/2001 | Aso | 439/660 |
| 7,364,434 | B2 | 4/2008 | Hu et al. | |
| 8,100,731 | B2 * | 1/2012 | Koyama et al. | 439/862 |
| 8,197,290 | B2 * | 6/2012 | Koyama et al. | 439/862 |
| D665,361 | S * | 8/2012 | Koyama et al. | D13/154 |
| 8,303,089 | B2 * | 11/2012 | Kim | 347/50 |
| 8,556,667 | B2 * | 10/2013 | Koyama et al. | 439/862 |
| 2011/0201217 | A1 * | 8/2011 | Koyama et al. | 439/83 |
| 2012/0108111 | A1 * | 5/2012 | Koyama et al. | 439/746 |
| 2012/0238141 | A1 * | 9/2012 | Koyama et al. | 439/625 |

FOREIGN PATENT DOCUMENTS

| | | | |
|---|---|---|---|
| JP | 9-274956 | A | 10/1997 |
| JP | 11-149954 | A | 6/1999 |
| JP | 3120893 | U | 4/2006 |

OTHER PUBLICATIONS

Office Action issued in priority application JP2011-055727, dated Apr. 22, 2011, with translation, 5 pages.
Final Office Action issued in priority application JP2011-055727, dated Dec. 14, 2011, with translation, 5 pages.
International Search Report issued in PCT/JP2011/057180, mailed on May 10, 2011, 5 pages.
Written Opinion issued in PCT/JP2011/057180, mailed on May 10, 2011, 5 pages.

* cited by examiner

*Primary Examiner* — James Harvey
(74) *Attorney, Agent, or Firm* — Osha Liang LLP

(57) ABSTRACT

A connector has a housing having a contact hole, and a movable contact that projects movably into and out of the contact hole of the housing. A contact surface of the movable contact is formed by an elastically deformable arc-shaped thin portion. The arc-shaped thin portion has a uniform thickness.

11 Claims, 8 Drawing Sheets t1 = t2

| | Before deformation | After deformation |
|---|---|---|
| Contact shape |   |   |
| t1 | 0.1 | |
| t2 | 0.1 | |
| Contact force (N) | 0.9 | |
| Size of R (mm) | 0.5 | 0.7 |
| Contact pressure (N/mm$^2$) | 1210 | 967 | t1 < t2

| | Before deformation | After deformation |
|---|---|---|
| Contact shape |   |   |
| t1 | 0.1 | |
| t2 | 0.17 | |
| Contact force (N) | 0.9 | |
| Size of R (mm) | 0.5 | 0.85 |
| Contact pressure (N/mm$^2$) | 1210 | 849 |

Fig. 7

Calculation of contact pressure by using Hertzian theory equation

| | | | Initial state | | After deformation | |
|---|---|---|---|---|---|---|
| CNT contact | Young's modulus | Ea (N/mm$^2$) | Phosphor bronze | 110000 | Phosphor bronze | 110000 |
| | Poisson's ratio | va | Phosphor bronze | 0.34 | Phosphor bronze | 0.34 |
| | Contact surface | Ra (mm) | Side surface shape | 0.5 | Side surface shape | 0.7 |
| | Contact load | P (N) | | 0.9 | | 0.9 |
| Battery pad | Young's modulus | Eb (N/mm$^2$) | Cu | 90000 | Cu | 90000 |
| | Poisson's ratio | vb | Cu | 0.34 | Cu | 0.34 |
| | Contact surface | Rb (mm) | Cu | 1000 | Cu | 1000 |
| Contact surface (mm) | | $a = \sqrt[3]{\frac{3P}{4}\left(\frac{1-\nu a^2}{Ea}+\frac{1-\nu b^2}{Eb}\right)\Big/\left(\frac{1}{Ra}+\frac{1}{Rb}\right)}$ | 0.019 | | 0.021 | |
| Contact pressure (N/mm$^2$) | | $p = 3P / 2\pi a^2$ | 1210 | | 967 | |

Fig. 8

Calculation of contact pressure by using Hertzian theory equation

| | | | Initial state | | After deformation | |
|---|---|---|---|---|---|---|
| CNT contact | Young's modulus | Ea (N/mm$^2$) | Phosphor bronze | 110000 | Phosphor bronze | 110000 |
| | Poisson's ratio | va | Phosphor bronze | 0.34 | Phosphor bronze | 0.34 |
| | Contact surface | Ra (mm) | Side surface shape | 0.5 | Side surface shape | 0.85 |
| | Contact load | P (N) | | 0.9 | | 0.9 |
| Battery pad | Young's modulus | Eb (N/mm$^2$) | Cu | 90000 | Cu | 90000 |
| | Poisson's ratio | vb | Cu | 0.34 | Cu | 0.34 |
| | Contact surface | Rb (mm) | Cu | 1000 | Cu | 1000 |
| Contact surface (mm) | | $a = \sqrt[3]{\frac{3P}{4}\left(\frac{1-\nu a^2}{Ea}+\frac{1-\nu b^2}{Eb}\right)\Big/\left(\frac{1}{Ra}+\frac{1}{Rb}\right)}$ | 0.019 | | 0.022 | |
| Contact pressure (N/mm$^2$) | | $p = 3P / 2\pi a^2$ | 1210 | | 849 | |

TERMINAL AND CONNECTOR USING THE SAME

BACKGROUND

1. Technical Field

The present invention relates to a terminal, for example, capable of being not only incorporated in a housing to form a connector but also directly mounted on a side end surface of a substrate to be used.

2. Background Art

Conventionally, as a terminal, for example, there is a spring connector including a conductive pin arranged slidably in the projecting and retreating directions so as not to be slipped off in a conductive tube, and a coil spring compressed for elastically biasing the conductive pin in the projecting direction, wherein a winding outer diameter of at least one part of the coil spring is set to be smaller than or the same as a winding inner diameter of the other part which is next turn of winding, and the one part is capable of being accommodated inside the other part in a state in which the coil spring is compressed (refer to Patent Document 1).

As shown in FIG. 1 of Patent Document 1, in the spring connector 20 described above, the conductive pin 14 is biased in the axial direction by the coil spring 26. By pressure contact with an abutment terminal 46 of a battery 44 shown in FIG. 5 thereof, electrical connection is formed while ensuring predetermined contact pressure.

Patent Document 1: Japanese Unexamined Patent Publication No. 11-149954

SUMMARY

However, in the spring connector described above, in a case where a distal end surface of the conductive pin is brought into contact with a connection pad of the battery, spring force of the coil spring locally concentrates on a distal end surface of the connection pad. Thus, there is a fear that a gilded layer of the connection pad is broken.

In a case where the spring connector is connected to a battery having a large capacity, a temperature easily becomes too high due to heat generation by contact resistance. Thus, electric current capacity allowing conducting is decreased.

One or more embodiments of the present invention provides a terminal capable of preventing breakage of a connection pad of a battery by reducing contact pressure without decreasing bias force to a movable contact thereof, and preventing a decrease in conducting capacity due to heat generation of the movable contact.

According to one or more embodiments of the present invention, the terminal is a terminal having a movable contact projecting movably into and out of a contact hole of a housing, wherein a contact surface of the movable contact is formed by an elastically deformable arc-shaped thin portion.

According to one or more embodiments of the present invention, in a case of pressure contact with a pad of a battery, the contact surface of the movable contact is elastically deformed, and a contact area is increased. Thus, contact pressure can be decreased without decreasing bias force to the movable contact, so that breakage of the connection pad of the battery can be prevented.

Since an exposed area in the movable contact is increased, cooling efficiency is improved. Thus, a terminal can be obtained in which a temperature does not easily become too high, and electric capacity allowing conducting is not easily decreased.

Further, since the contact surface of the movable contact is formed by the arc-shaped thin portion, a mass of the movable contact itself is reduced, so that inertia force is reduced. Therefore, even when impact force from the outside such as impact force due to dropping is applied to the housing, an instantaneous interruption which is an electric connection failure instantaneously generated by the inertia force of the movable contact can be prevented.

According to one or more embodiments of the present invention, the arc-shaped thin portion may have a uniform thickness.

According to one or more embodiments of the present invention, a terminal easily manufactured by press molding or electrocasting can be obtained.

According to one or more embodiments of the present invention, the arc-shaped thin portion may become gradually thicker toward a base portion.

According to one or more embodiments of the present invention, stress does not easily concentrate on the base portion of the arc-shaped thin portion, so that the terminal having longer life can be obtained.

In a connector according to one or more embodiments of the present invention, the movable contact of the above-described terminal projects movably into and out of a contact hole provided in a housing.

According to one or more embodiments of the present invention, in a case of the pressure contact with the connection pad of the battery, the contact surface of the movable contact is elastically deformed, and the contact area is increased. Thus, the contact pressure can be decreased without decreasing the bias force to the movable contact, so that the breakage of the connection pad of the battery can be prevented.

Since the exposed area in the movable contact is increased, the cooling efficiency is improved. Thus, a connector in which a temperature does not easily become too high, and electric capacity allowing conducting is not easily decreased can be obtained.

Further, since the contact surface of the movable contact is formed by the arc-shaped thin portion, the mass of the movable contact itself is reduced, so that the inertia force is reduced. Therefore, even when the impact force from the outside such as the impact force due to dropping is applied to the housing, the instantaneous interruption which is the electric connection failure instantaneously generated by the inertia force of the movable contact can be prevented.

According to one or more embodiments of the present invention, the contact surface of the movable contact may be elastically deformed at the time of pressing an object subjected to contact.

According to one or more embodiments of the present invention, there is an effect that the stress does not easily concentrate, and the connector having longer life can be obtained.

BRIEF DESCRIPTION OF THE DRAWINGS

FIG. 7 is a table showing conditions for calculating a change in contact pressure between before and after the operation of the terminal according to the table shown in FIG. 6(*a*), and results thereof.

FIG. 8 is a table showing results of calculating the change in the contact pressure between before and after the operation of the terminal according to the table shown in FIG. 6(*b*) under different conditions.

DETAILED DESCRIPTION

Embodiments of the present invention will be described with reference to FIGS. 1 to 8. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

As shown in FIGS. 1 to 5, according to one or more embodiments of the present invention, a connector has fixing tools 20 that are press-fitted to a resin-molded housing 10 having a height of 4 mm at a predetermined pitch, and connection terminals 30 are press-fitted between the fixing tools 20, 20.

Figure 2:
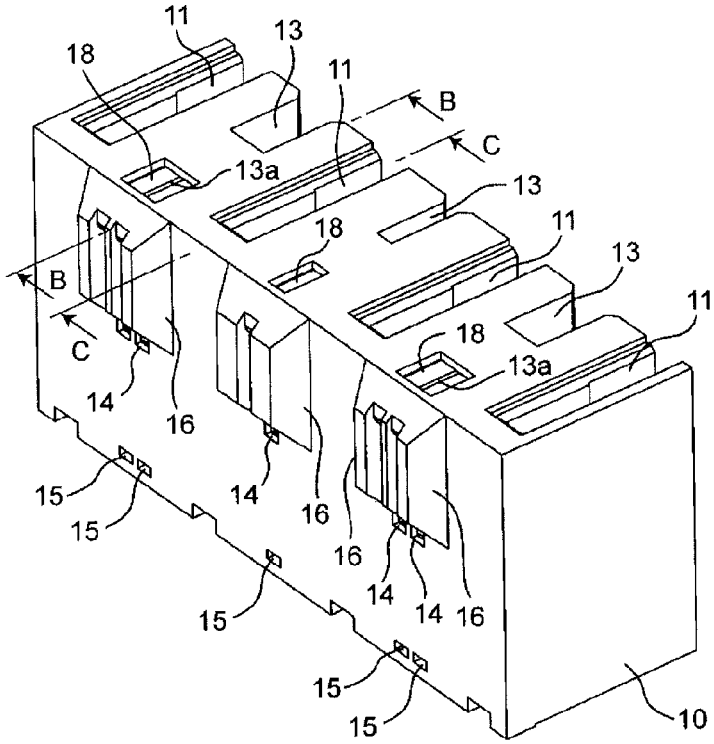
FIG. 2(*a*) is a perspective view showing a housing to which the terminals are assembled, and FIGS. 2(*b*) and 2(*c*) are sectional perspective views taken along line B-B and line C-C shown in FIG. 2(*a*), according to one or more embodiments of the present invention.
Figure 2:
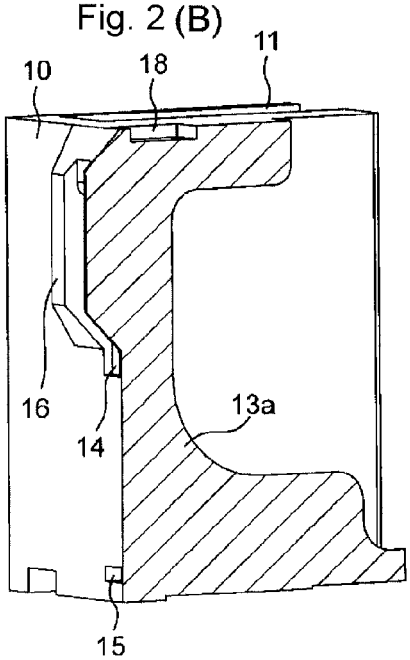
Figure 2:
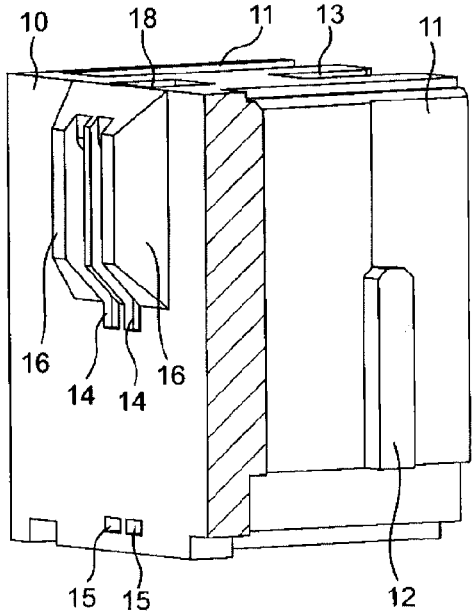

As shown in FIG. 2, in the housing 10, first housing spaces 11 into which the fixing tools 20 can be press-fitted from the upper side are provided at a predetermined pitch, and locking projections 12 are provided on facing inner surfaces of the first housing spaces 11. In the housing 10, three second housing spaces 13 into which the connection terminals 30 can be press-fitted from the rear surface side are arranged side by side between the first housing spaces 11, 11. In particular, the second housing spaces 13 provided in both ends are partitioned by partition walls 13*a*. Further, in the housing 10, on the front surface side thereof, contact holes 14 into and out of which movable contacts 36, to be hereinafter described, can be moved, the contact holes communicating with the second housing spaces 13 are provided, and press-fitting holes 15 communicating with the second housing spaces 13 are provided. Reinforcing ribs 16 are arranged in a projecting manner in both side opening edges of the contact holes 14, and position regulating receiving portions 17 are formed in upper edges of the contact holes 14. In the housing 10, inspection holes 18 communicating with the second housing spaces 13 are provided in front surface side edges of an upper surface thereof.

Figure 3:
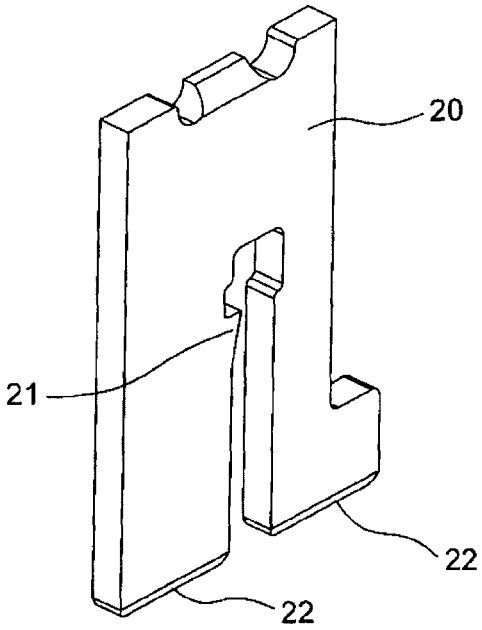
FIGS. 3(*a*) and 3(*b*) are perspective views of a fixing tool and the terminal shown in FIG. 1.
Figure 3:
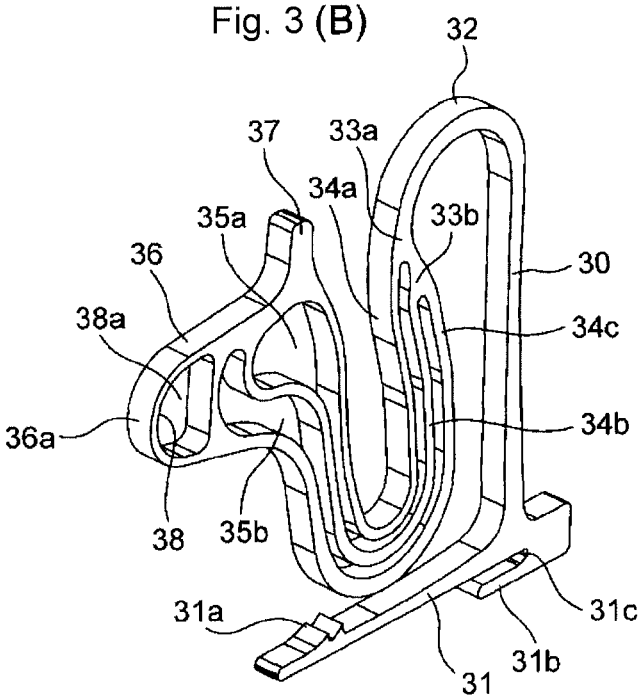
Figure 4A:
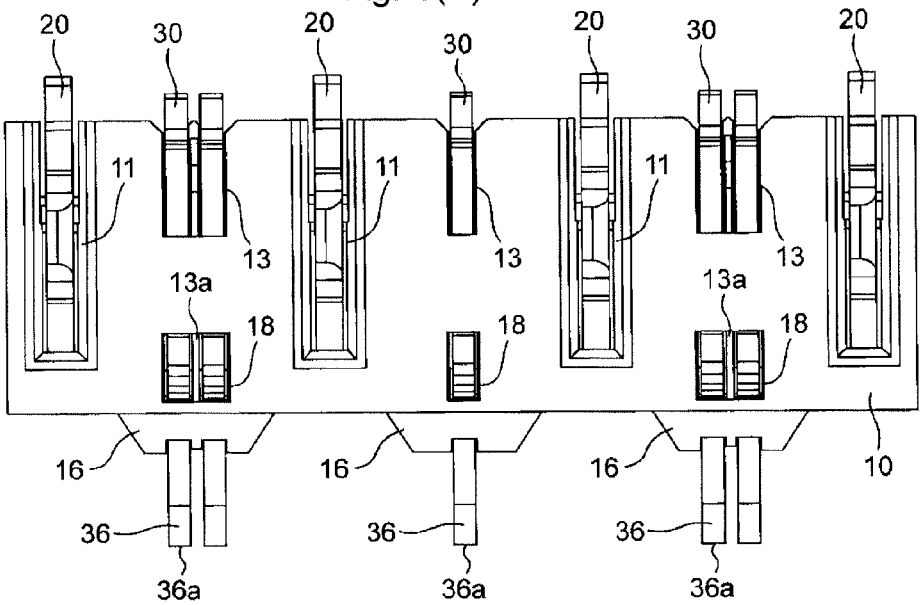
FIGS. 4(*a*) and 4(*b*) are plan views showing before and after an operation of the terminals according to the connector shown in FIG. 1.
Figure 4:
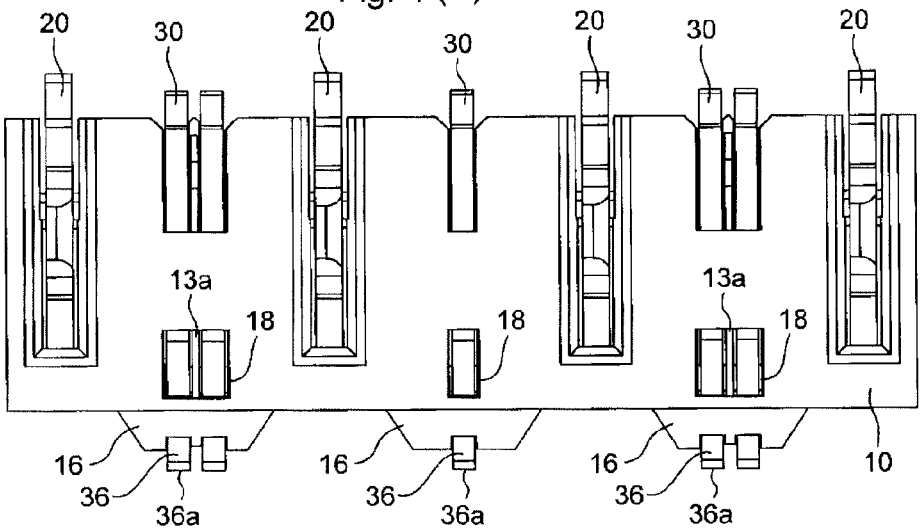
Figure 5:
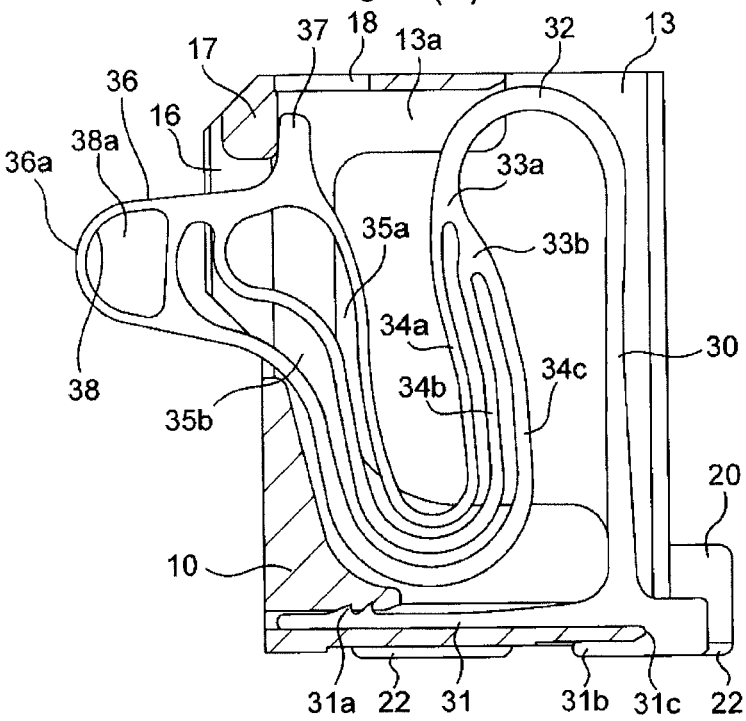
FIGS. 5(*a*) and 5(*b*) are sectional views showing before and after the operation of the terminal according to the connector shown in FIG. 1.
Figure 5:
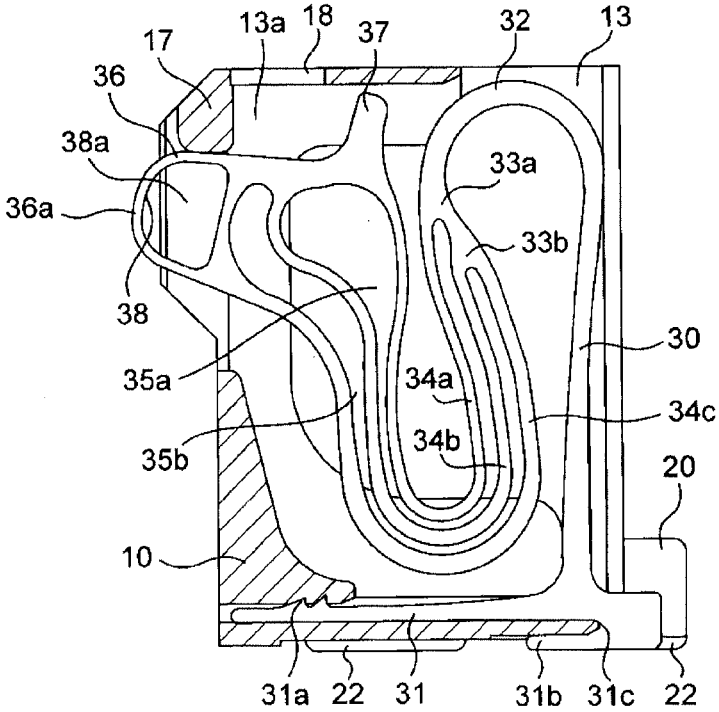

As shown in FIG. 3(*a*), the fixing tool 20 is a substantially gate shape press-molded product formed by punching out a metal thin plate by press working, and a locking claw 21 is arranged in a projecting manner on an inner surface thereof. Therefore, when the fixing tool 20 is press-fitted into the first housing space 11 of the housing 10 from the upper side, the locking claw 21 is locked onto the locking projection 12 of the housing 10, so that the fixing tool 20 is retained, and fixing lower ends 22 of the fixing tool 20 are exposed from a bottom surface of the housing 10 so as to be connected and fixed (FIG. 5).

As shown in FIG. 3(*b*), in the connection terminal 30, a substantially J-shaped support portion 32 projects upward from a press-fitting fixing portion 31, a first extending portion 34*a* and a second branch portion 33*b* extend from a first branch portion 33*a* positioned in a distal end of the support portion 32, and second and third extending portions 34*b*, 34*c* branch off from the second branch portion 33*b*.

While a locking claw 31*a* is arranged in a projecting manner on an upper surface of one end of the press-fitting fixing portion 31, by providing a connection portion 31*b* from a lower surface of the other end thereof, a press-fitting cutout portion 31*c* is formed.

The first, second, and third extending portions 34*a*, 34*b*, 34*c* branching off from the first branch portion 33*a* and the second branch portion 33*b* extend so as to meander in substantially parallel, so that first and second slits 35*a*, 35*b* are formed. Therefore, stress concentration on the branch portions 33*a*, 33*b* is not easily generated, so that there are advantages that the life is extended and a degree of freedom in design is increased.

Further, the movable contact 36 is provided in a free end formed by integrating distal ends of the first, second, and third extending portions 34*a*, 34*b*, 34*c*, and a position regulating projecting portion 37 is arranged in a projecting manner in the distal end of the first extending portion 34*a*. A contact surface 36*a* of the movable contact 36 is formed by an elastically deformable arc-shaped thin portion 38. It should be noted that the arc-shaped thin portion 38 is only required to be elastically deformable, and may have uniform thickness or may be formed to become gradually thicker toward a base portion.

It should be noted that the thickness in curved parts of the first, second, and third extending portions 34*a*, 34*b*, 34*c* is gradually increased in one or more embodiments of the present invention. Therefore, there is an advantage that the stress concentration at the time of an operation is not easily generated, so that the life is extended.

The width of the first and second slits 35*a*, 35*b* according to one or more embodiments of the present invention is set in such a manner that even when the movable contact 36 of the connection terminal 30 is operated, the first, second, and third extending portions 34*a*, 34*b*, 34*c* are not brought into contact with each other. Therefore, the first, second, and third extending portions 34*a*, 34*b*, 34*c* are not brought into contact with each other at the time of a predetermined operation, and an unpleasant contact sound is not generated.

Further, since the contact surface 36*a* of the movable contact 36 is formed by the elastically deformable arc-shaped thin portion, a cooling through hole is formed behind the movable contact surface 36*a*, so that an exposed area is increased. Therefore, even when heat is generated based on contact resistance, there is an advantage that cooling can be efficiently performed and a temperature of the movable contact 36 does not easily become too high.

Figure 1:
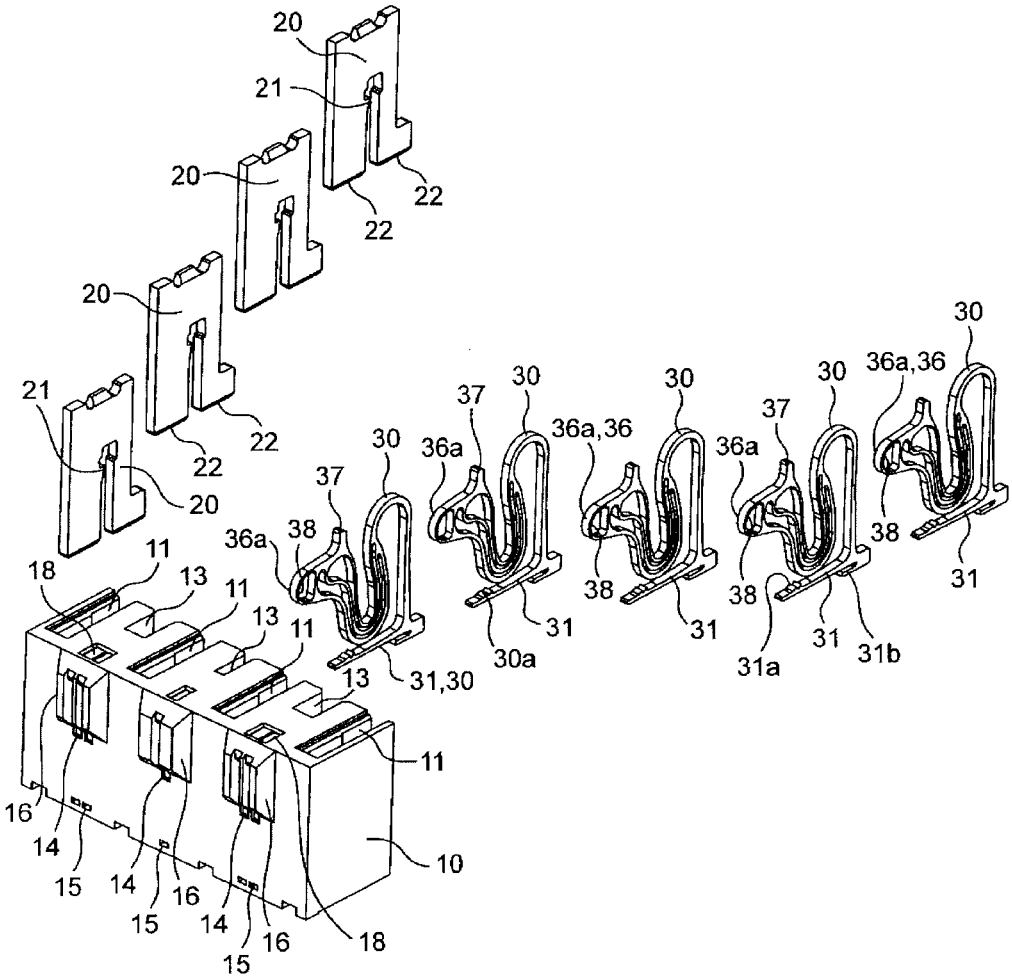
FIG. 1 is an exploded perspective view showing a connector to which terminals are assembled, according to one or more embodiments of the present invention.

As shown in FIG. 1, the connection terminals 30 are inserted into the second housing spaces 13 of the housing 10 from the rear surface side. The press-fitting fixing portions 31 are press-fitted into the press-fitting holes 15, the locking claws 31*a* are locked onto inner surfaces of the press-fitting holes 15, and the cutout portions 31*c* are engaged with an edge of the housing 10, so that fixing can be performed. Thereby, the position regulating projecting portions 37 of the connection terminals 30 are abutted with the position regulating receiving portions 17 of the housing 10 so that a position is regulated, and the connection portions 31*b* of the connection terminals 30 become flush with the fixing lower ends 22 of the fixing tools 20.

Next, when the movable contacts 36 are pushed in by pressure contact of the connector in which a print substrate (not shown) is mounted with a battery of a mobile electronic device for example, the first, second, and third extending portions 34*a*, 34*b*, 34*c* are elastically deformed, and the support portions 32 are also elastically deformed. Within a predetermined range of a push-in amount, since the width of the first and second slits 35*a*, 35*b* is large, the first, second, and third extending portions 34*a*, 34*b*, 34*c* are not brought into contact with each other, so that a friction sound is not generated. In particular, since the meandering first, second, and third extending portions 34*a*, 34*b*, 34*c* and the support portions 32 are arranged between the movable contacts 36 and the press-fitting fixing portions 31, a spring length is long. Thus, a desired displacement amount can be ensured, and the stress concentration is not easily generated. Therefore, contact reliability is improved and the connector having the longer life can be obtained.

Moreover, since cooling through holes 38*a* are provided, even when the movable contacts 36 generate heat based on the contact resistance, there is an advantage that the cooling can be efficiently performed and the temperature does not easily become too high.

It should be noted that although a case where one pair of two connection terminals and an individual connection terminal are combined in order to enhance the contact reliability is described above, only an individual connection terminal may be used for all, or one pair of two connection terminals may be used for all. Further, one pair of three connection terminals may be incorporated, and if necessary, the number of the connection terminals can be selected as a matter of course.

The extending portions and the slits are not required to have uniform width but the width may be changed if necessary. For example, by increasing only the width of the curved parts of the extending portions positioned on the outer side among the curved parts of the extending portions so as to prevent generation of the stress concentration, durability may be enhanced.

Further, although a case where the connection terminals are incorporated in the housing is described above, the print substrate itself may serve as the housing and the connection terminals of the present application may be directly incorporated in a side end surface thereof. Accordingly, there is an advantage that the housing and the fixing tools described above are not required, and as a result, the entire device can be furthermore downsized.

EXAMPLES

Figure 6:
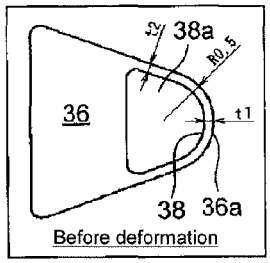
FIGS. 6(*a*) and 6(*b*) are tables showing results of calculating elastic deformation of a contact surface in a movable contact of the terminal under different conditions, according to one or more embodiments of the present invention.
Figure 6:
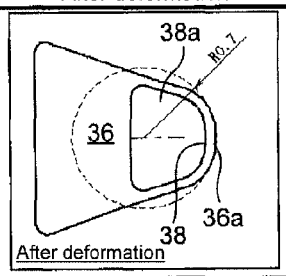
Figure 6:
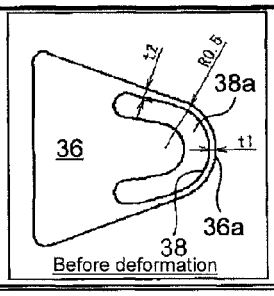
Figure 6:
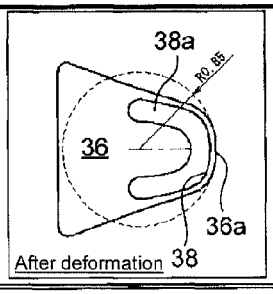

FIGS. 6(*a*) and 6(*b*) respectively show results of calculating conversion of contact pressure in a case where the arc-shaped thin portion has a uniform thickness (FIGS. 6(*a*) and 7) and a case where the thickness of the arc-shaped thin portion becomes thicker toward the base portion (FIGS. 6(*b*) and 8) by using Hertzian theory equations.

Example 1

That is, in a case where the arc-shaped thin portion has a thickness of 0.1 mm, a curvature radius of the contact surface is 0.5 mm, and a thickness of the base portion thereof is 0.1 mm, and when contact force of 0.9 N is applied as spring force, it is found that the curvature radius of the contact surface is changed from 0.5 mm to 0.7 mm, and contact pressure is decreased from 1210 ($N/mm^2$) to 967 ($N/mm^2$). Thereby, it is found that even with the same contact force, when the curvature radius of the contact surface is increased, a contact area with an object subjected to contact is increased, and local stress concentration is eased, so that breakage of connection pads of the battery can be prevented.

Example 2

In a case where the thickness of the contact surface of the arc-shaped thin portion is 0.1 mm, the curvature radius of the contact surface is 0.5 mm, and the thickness of the base portion thereof is 0.17 mm, and when the contact force of 0.9 N is applied as the spring force, it is found that the curvature radius of the contact surface is changed from 0.5 mm to 0.85 mm, and the contact pressure is decreased from 1210 ($N/mm^2$) to 849 ($N/mm^2$). Thereby, as well as the above description, it is found that when the curvature radius of the contact surface is more increased, the contact area with the object subjected to contact is more increased, and the local stress concentration is eased, so that the breakage of the connection pads of the battery can be prevented.

It should be noted that in a case where the thickness of the arc-shaped thin portion becomes thinner toward the base portion, even when the contact force is applied as the spring force, the curvature radius of the contact surface is not changed, and the local stress concentration cannot be eased.

Therefore, a condition under which the arc-shaped thin portion is elastically deformed when pressing the object subjected to contact is a case where the arc-shaped thin portion has a uniform thickness or a case where the thickness of the arc-shaped thin portion becomes thicker toward the base portion.

The terminals are not particularly limited to the shape described above.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF SYMBOLS

10: Housing
13: Second housing space
14: Contact hole
17: Position regulating receiving portion
20: Fixing tool
30: Connection terminal
31: Press-fitting fixing portion
32: Support portion
33*a*, 33*b*: First branch portion, second branch portion
34*a*, 34*b*, 34*c*: First, second, third extending portion
35*a*, 35*b*: First, second slit
36: Movable contact
36*a*: Contact surface
37: Position regulating projecting portion
38: Arc-shaped thin portion
38*a*: Cooling through hole

The invention claimed is:

1. A terminal comprising:

a movable contact that projects movably into and out of a contact hole of a housing, wherein a contact surface of the movable contact is formed by an elastically deformable arc-shaped thin portion such that, when the movable contact is pushed in by pressure contact, the radius of curvature of the contact surface increases.

2. The terminal according to claim 1, wherein the arc-shaped thin portion has a uniform thickness.

3. The terminal according to claim 1, wherein the arc-shaped thin portion becomes gradually thicker toward a base portion.

4. A connector comprising:

a housing having a contact hole;

a movable contact that projects movably into and out of the contact hole of the housing, wherein a contact surface of the movable contact is formed by an elastically deformable arc-shaped thin portion such that, when the movable contact is pushed in by pressure contact, the radius of curvature of the contact surface increases.

5. The connector according to claim 4, wherein the contact surface of the movable contact is elastically deformed in pressing an object subjected to contact.

6. The connector according to claim 4, wherein the arc-shaped thin portion has a uniform thickness.

7. The connector according to claim 4, wherein the arc-shaped thin portion becomes gradually thicker toward a base portion.

8. The connector according to claim 5, wherein the arc-shaped thin portion has a uniform thickness.

9. The connector according to claim 5, wherein the arc-shaped thin portion becomes gradually thicker toward a base portion.

10. The terminal according to claim 1, wherein both ends of the movable contact are supported by at least two elastically deformable extension portions that meander substantially parallel to each other.

11. The connector according to claim 5, wherein both ends of the movable contact are supported by at least two elastically deformable extension portions that meander substantially parallel to each other.

* * * * *